US008262503B2

(12) United States Patent
Horacek et al.

(10) Patent No.: US 8,262,503 B2
(45) **Date of Patent: *Sep. 11, 2012**

(54) GOLF CLUB HEAD

(75) Inventors: Robert J. Horacek, Hermosa Beach, CA (US); Nathaniel J. Radcliffe, Huntington Beach, CA (US); John J. Rae, Westminster, CA (US); Michael J. Wallans, Huntington Beach, CA (US); Sam G. Lacey, Westminster, CA (US)

(73) Assignee: SRI Sports Limited, Kobe-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/295,927

(22) Filed: Nov. 14, 2011

(65) Prior Publication Data

US 2012/0058840 A1 Mar. 8, 2012

Related U.S. Application Data

(63) Continuation of application No. 13/047,569, filed on Mar. 14, 2011, now Pat. No. 8,088,024, which is a continuation of application No. 12/789,117, filed on May 27, 2010, now Pat. No. 7,927,232, which is a continuation of application No. 12/476,945, filed on Jun. 2, 2009, now Pat. No. 7,815,522, which is a continuation of application No. 11/441,244, filed on May 26, 2006, now Pat. No. 7,585,233.

(51) Int. Cl.
*A63B 53/04* (2006.01)

(52) U.S. Cl. ..... 473/329; 473/345; 473/346; 473/350

(58) Field of Classification Search ..... 473/324–350, 473/287–292; D21/733, 747, 748, 752, 759
See application file for complete search history.

(56) References Cited

U.S. PATENT DOCUMENTS

| | | | |
|---|---|---|---|
| 1,582,836 | A | 4/1926 | Link |
| 4,429,879 | A | 2/1984 | Schmidt |
| 4,465,221 | A | 8/1984 | Schmidt |
| 4,502,687 | A | 3/1985 | Kochevar |
| 4,511,145 | A | 4/1985 | Schmidt |
| 4,602,787 | A | 7/1986 | Sugioka et al. |
| 4,932,658 | A | 6/1990 | Antonious |
| 5,000,454 | A | 3/1991 | Soda |
| 5,024,437 | A | 6/1991 | Anderson |
| D319,857 | S | 9/1991 | Antonious |
| 5,094,383 | A | 3/1992 | Anderson et al. |
| 5,207,428 | A | 5/1993 | Aizawa |

(Continued)

FOREIGN PATENT DOCUMENTS

JP A-2000-317018 11/2000

OTHER PUBLICATIONS

Jul. 10, 2009 Notice of Allowance issued in U.S. Appl. No. 11/441,244.

(Continued)

*Primary Examiner* — Sebastiano Passaniti
(74) *Attorney, Agent, or Firm* — Oliff & Berridge, PLC

(57) ABSTRACT

A hollow golf club head includes a sole, a crown, a skirt, and a striking face. The golf club includes a junction interconnecting the sole, crown, and skirt to the striking face, the junction including at least one stiffening member.

18 Claims, 16 Drawing Sheets

U.S. PATENT DOCUMENTS 5,261,664 A 11/1993 Anderson
5,292,129 A 3/1994 Long et al.
5,295,689 A 3/1994 Lundberg
5,328,184 A 7/1994 Antonious
5,362,055 A 11/1994 Rennie
5,390,924 A 2/1995 Antonious
5,395,113 A 3/1995 Antonious
5,419,559 A 5/1995 Melanson et al.
5,451,058 A 9/1995 Price et al.
5,482,279 A 1/1996 Antonious
5,533,729 A 7/1996 Leu
5,547,427 A 8/1996 Rigal et al.
5,564,994 A 10/1996 Chang
5,669,829 A 9/1997 Lin
5,704,850 A 1/1998 Shieh
5,709,615 A 1/1998 Liang
5,711,722 A 1/1998 Miyajima et al.
5,755,627 A 5/1998 Yamazaki et al.
5,908,356 A 6/1999 Nagamoto
5,941,782 A 8/1999 Cook
5,997,415 A 12/1999 Wood
6,059,669 A 5/2000 Pearce
6,162,133 A 12/2000 Peterson
6,183,377 B1 2/2001 Liang
6,193,614 B1 2/2001 Sasamoto et al.
6,299,547 B1 10/2001 Kosmatka
6,299,549 B1 10/2001 Shieh
6,422,951 B1 7/2002 Burrows
6,454,665 B2 9/2002 Antonius
6,478,693 B2 * 11/2002 Matsunaga et al. ..... 473/345
6,524,197 B2 2/2003 Boone
6,551,199 B2 4/2003 Viera
6,582,321 B2 * 6/2003 Galloway et al. ..... 473/329
6,595,871 B2 7/2003 Sano
6,638,182 B2 10/2003 Kosmatka
6,685,576 B2 2/2004 Kosmatka
6,832,961 B2 12/2004 Sano
6,839,975 B2 1/2005 Fujishima
6,840,872 B2 1/2005 Yoneyama
6,851,159 B1 2/2005 Nikolic et al.
6,852,038 B2 2/2005 Yabu
6,979,270 B1 12/2005 Allen
7,029,403 B2 4/2006 Rice
7,140,974 B2 11/2006 Chao et al.
7,247,104 B2 7/2007 Poynor
7,258,629 B2 8/2007 Chen
7,585,233 B2 9/2009 Horacek et al.
7,815,522 B2 10/2010 Horacek et al.
7,927,232 B2 4/2011 Horacek et al.
8,088,024 B2 * 1/2012 Horacek et al. ..... 473/345
2002/0019265 A1 2/2002 Allen
2002/0055396 A1 5/2002 Nishimoto et al.
2002/0169035 A1 11/2002 Liu
2002/0169036 A1 11/2002 Boone
2003/0013542 A1 1/2003 Burnett et al.
2003/0027662 A1 2/2003 Werner et al.
2003/0190975 A1 10/2003 Fagot
2004/0038750 A1 2/2004 Lo
2004/0157678 A1 8/2004 Kohno
2004/0176180 A1 9/2004 Yamaguchi et al.
2004/0219991 A1 11/2004 Suprock et al.
2005/0137029 A1 6/2005 Evans et al.
2005/0148405 A1 7/2005 Imamoto
2005/0197207 A1 9/2005 Chen
2005/0272523 A1 12/2005 Atkins
2006/0079345 A1 4/2006 Gibbs
2006/0111200 A1 5/2006 Poynor
2006/0172818 A1 8/2006 Yamamoto
2006/0293119 A1 12/2006 Hou
2008/0139338 A1 6/2008 Matsunaga et al.

OTHER PUBLICATIONS

May 22, 2009 Office Action issued in U.S. Appl. No. 11/441,244.
Dec. 10, 2008 Office Action issued in U.S. Appl. No. 11/441,244.
Aug. 7, 2008 Office Action issued in U.S. Appl. No. 11/441,244.
Jan. 11, 2008 Office Action issued in U.S. Appl. No. 11/441,244.
Sep. 1, 2010 Notice of Allowance issued in U.S. Appl. No. 12/476,945.
Jun. 21, 2010 Notice of Allowance issued in U.S. Appl. No. 12/476,945.
Apr. 12, 2010 Office Action issued in U.S. Appl. No. 12/476,945.
Oct. 15, 2009 Office Action issued in U.S. Appl. No. 12/476,945.
Feb. 25, 2011 Notice of Allowance issued in U.S. Appl. No. 12/789,117.
Oct. 27, 2010 Office Action issued in U.S. Appl. No. 12/789,117.
May 4, 2011 Office Action issued in U.S. Appl. No. 13/047,569.
Sep. 12, 2011 Notice of Allowance issued in U.S. Appl. No. 13/047,569.

* cited by examiner

GOLF CLUB HEAD

RELATED U.S. APPLICATION DATA

Continuation of application Ser. No. 13/047,569, filed on Mar. 14, 2011, which is a continuation of application Ser. No. 12/789,117, filed on May 27, 2010, now U.S. Pat. No. 7,927,232, which is a continuation of application Ser. No. 12/476,945, filed on Jun. 2, 2009, now U.S. Pat. No. 7,815,522, which is a continuation of application Ser. No. 11/441,244, filed on May 26, 2006, now U.S. Pat. No. 7,585,233.

BACKGROUND

With the advent of thin walled metalwood golf club heads, the performance of metalwood clubs has improved considerably. By increasing the surface area of the striking face, using high strength alloys for its construction, and reducing its thickness to introduce a "trampoline" effect, club head designers have increased the efficiency of energy transfer from a metalwood club to a golf ball. As a result, the United States Golf Association (USGA) has imposed regulations to limit energy transferred from drivers to a golf ball by defining a maximum "characteristic time" (CT) that the clubface may remain in contact with a suspended steel weight impacting it. The maximum CT corresponds to a maximum "coefficient of restitution" (COR) for metalwood clubs. Currently, the maximum COR permissible by the USGA is 0.830.

SUMMARY

For golf club striking faces of a fixed size and substantially constant thickness, there exists a thickness below which the CT value will be outside the range allowable by the USGA, but that may still be structurally feasible for use on a club head. Limiting the amount of material used to construct a club's face is desirable for cost savings and improved mass properties.

Various metalwood designs have been proposed utilizing variable face thickness profiles that both meet the USGA's CT limitation and minimize face mass. However, such faces are typically expensive to produce. Other designs have incorporated thin faces with protracted rib or support structures appended to or formed integrally with the striking face, and these too have proven costly to manufacture, and increase complexity of the club head design.

A need exists for improved USGA conforming metalwood golf club heads which minimize the amount of material used to construct the club face, as well as for hollow golf club heads which maximize average energy transfer efficiency of the striking face.

Various implementations of the broad principles described herein provide a golf club head which may be manufactured with a face that utilizes less material than a conventional design, and that may conform to USGA rules and regulations for metal woods. Further, features are proposed which may improve performance characteristics of hollow club heads, and increase the average energy transfer efficiency such heads' striking faces.

BRIEF DESCRIPTION OF THE DRAWINGS

Various implementations will now be described, by way of example only, with reference to the following drawings in which:

FIG. 3(*b*) is a further enlarged view of an exemplary configuration for detail III of FIG. 2.

FIG. 3(*c*) is a further enlarged view of an exemplary configuration for detail III of FIG. 2.

FIG. 3(*d*) is a further enlarged view of an exemplary configuration for detail III of FIG. 2.

FIG. 4(*b*) is a close up view of detail IV of FIG. 4(*a*).

FIG. 8(*b*) is an enlarged view of an exemplary detail VIII of FIG. 8(*a*).

FIG. 8(*c*) is an enlarged view of an exemplary detail VIII of FIG. 8(*a*).

FIG. 8(*d*) is an enlarged view of an exemplary detail VIII of FIG. 8(*a*).

FIG. 8(*e*) is an enlarged view of an exemplary detail VIII of FIG. 8(*a*).

FIG. 8(*f*) is an enlarged view of an exemplary detail VIII of FIG. 8(*a*).

FIG. 8(*g*) is an enlarged view of an exemplary detail VIII of FIG. 8(*a*).

FIG. 8(*h*) is an enlarged view of an exemplary detail VIII of FIG. 8(*a*).

FIG. 8(*i*) is cross sectional view of an exemplary detail VIII of FIG. 8(*h*) taken at line VIII(i)-VIII(i).

FIG. 9(*b*) is an enlarged view of an exemplary detail VIII of FIG. 8(*a*).

FIG. 9(*c*) is an enlarged view of an exemplary detail VIII of FIG. 8(*a*).

FIG. 14(*b*) is an enlarged view of an exemplary detail XI of FIG. 14(*a*).

FIG. 15(*b*) is an enlarged view of an exemplary detail XI of FIG. 14(*a*).

FIG. 15(*c*) is an enlarged view of an exemplary detail XI of FIG. 14(*c*).

For the purposes of illustration these figures are not necessarily drawn to scale. In all of the figures, like components are designated by like reference numerals.

DETAILED DESCRIPTION

Throughout the following description, specific details are set forth in order to provide a more thorough understanding of the broad inventive principles discussed herein. However, these broad principles may be practiced without these particulars and thus these details need not be limiting. In other instances, well known elements have not been shown or described to avoid unnecessarily obscuring the invention. Accordingly, the detailed description and drawings are to be regarded in an illustrative rather than a restrictive sense.

Figure 1:
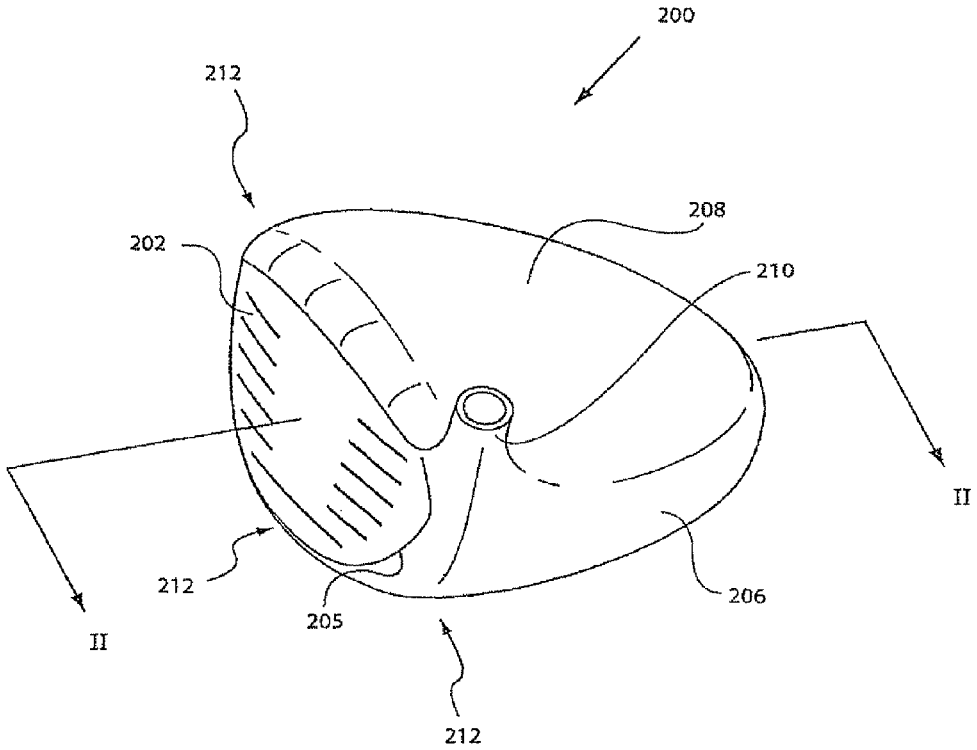
FIG. 1 is a perspective view of an exemplary club head.

With reference to FIG. 1, a golf club head 200 is shown having four primary surfaces, each defining a portion of the head: a front surface generally defining a striking face 202 generally bounded by a face perimeter edge 205, a bottom surface generally defining a sole 204 (shown in FIG. 2), a side surface generally defining a skirt 206, and a top surface generally defining a crown 208. The sole, the crown, the strike surface, and a rear portion of the club head may at least partially delimit a substantially enclosed interior cavity. Optionally, a hosel 210 may be provided for receiving a shaft (not shown) to which the head 200 may be attached. The face 202 is connected to the sole, skirt and crown via a junction 212.

Figure 2:
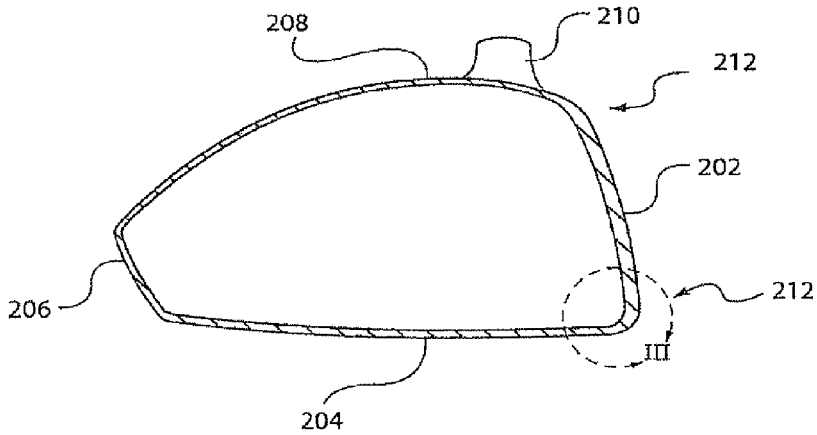
FIG. 2 is a cross-sectional view of the club head of FIG. 1 taken at line II-II.
Figure 3A:
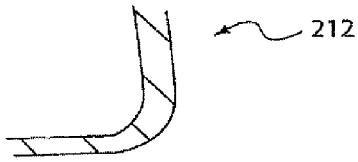
FIG. 3(*a*) is an enlarged view of an exemplary configuration for detail III of FIG. 2.
Figure 3B:
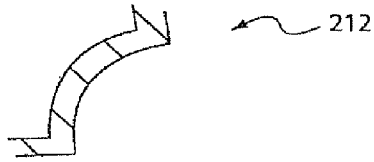
Figure 3C:
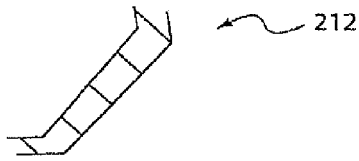
Figure 3D:
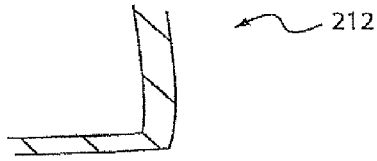

FIG. 2 shows section II-II of head 200 from FIG. 1, with junction 212 generally connecting the striking face 202 to the crown 208, and to the sole 206 at detail III.

FIGS. 3(*a*)-3(*d*) show several enlarged views of detail III from FIG. 2, each demonstrating a unique example of a possible configuration for the junction 212. It should be appreciated that while the junction configurations of FIGS. 3(*a*)-3(*d*) are shown generally connecting the face 202 to the sole 204, each configuration may be used to connect the face to the crown 208, and/or the skirt 206. A single junction configuration may be used to connect the face 202 to each of the sole, the crown, and the skirt. Alternatively, the various junction configurations may be used interchangeably and in any combination.

As in FIG. 3(*a*), the junction may generally comprise a convex, or outwardly radiused or contoured corner. The radius, or contour, may vary along the generally annular extent of the junction, and may or may not be a constant radius at any single location.

As shown in FIG. 3(*b*), the junction may generally comprise a concave, or inwardly radiused or contoured corner. The radius, or contour, may vary along the generally annular extent of the junction, and may or may not be a constant radius at any single location.

FIG. 3(*c*) demonstrates the junction having a generally beveled configuration.

FIG. 3(*d*) shows the junction generally embodied as a corner.

Figure 4A:
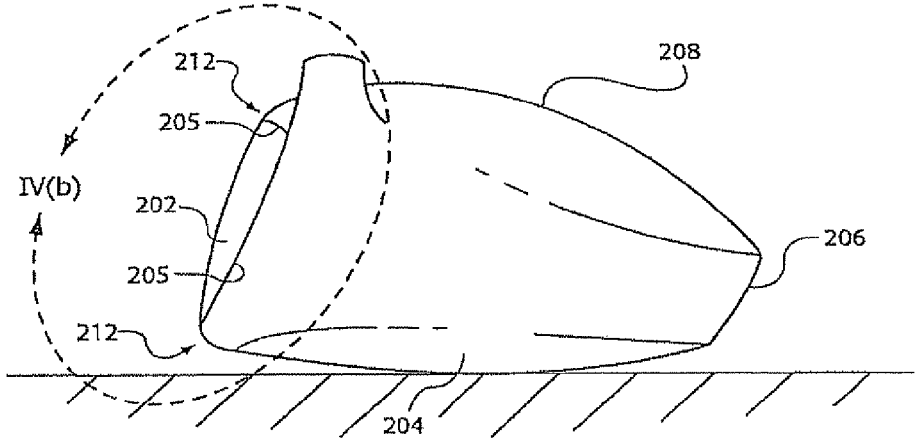
FIG. 4(*a*) is a heel view of the club head of FIG. 1.
Figure 4B:
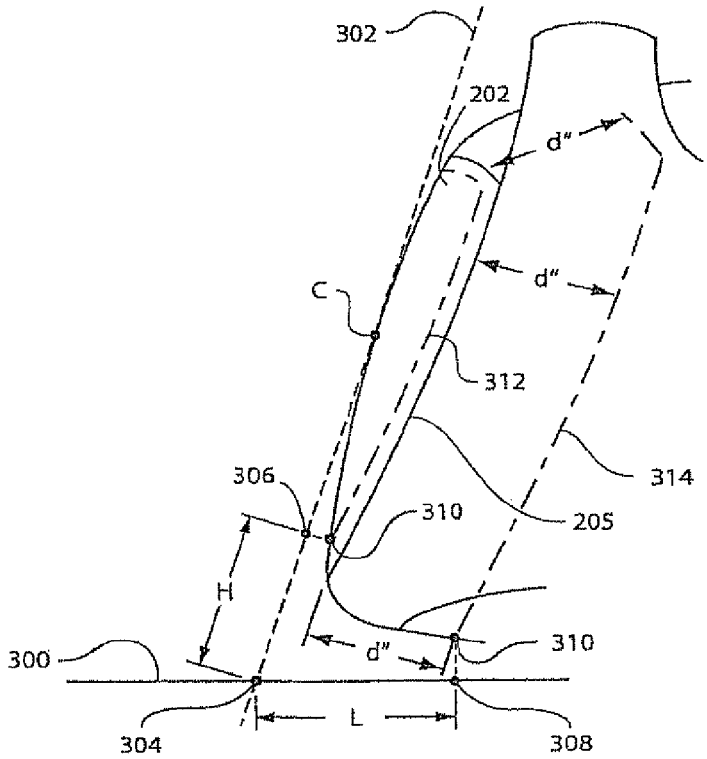
Figure 5:
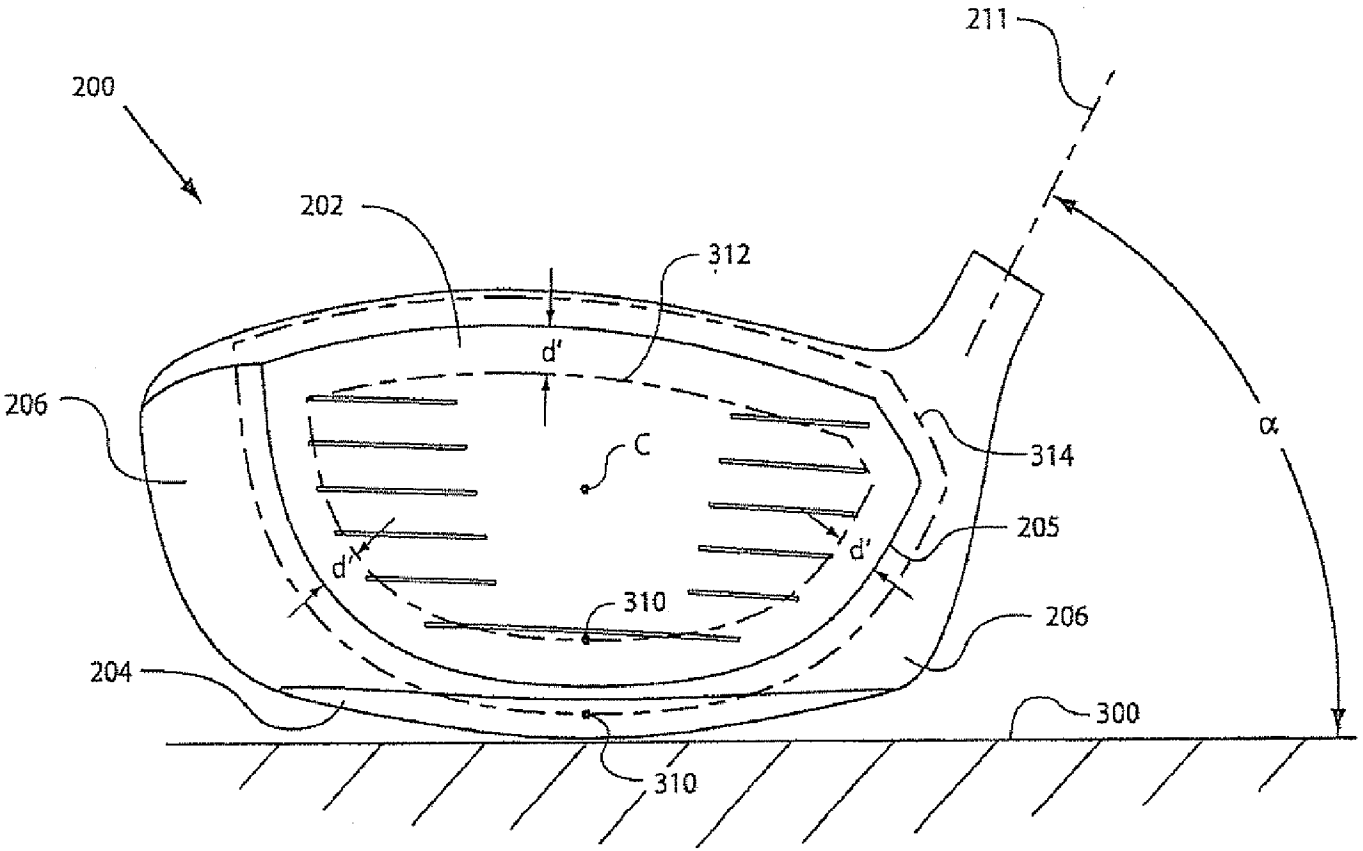
FIG. 5 is a front view of the club head of FIG. 1.

In the following examples, the junction may comprise any adjacent portions of the face 202, sole 204, skirt 206, and crown 208. Generally, the junction is defined as a portion of the head which interconnects the face 202 to at least a portion of the remainder of the head 200. Since there are a variety of possible configurations for the junction 212, including those presented above and others, it may be beneficial to define the junction as shown in FIG. 4(*a*). With the sole 206 resting on a substantially planar surface 300 and a hosel axis 211 positioned at a designated lie angle, α, (see FIG. 5) typically between about 45 to about 65 degrees, an imaginary line 302 (see FIG. 4(*b*)), tangent to the strike face at a geometric center, C, may be located in an imaginary vertical plane perpendicular to the strike face and passing through the geometric center. In this example, the face 202 is shown having vertical roll curvature. The imaginary line 302 and the planar surface 300 intersect at a first reference point 304, which may serve as a point of origin from which junction 212 may generally be represented dimensionally by a height, H, and a length, L. H may be measured along the direction of the imaginary line 302, from the first reference point 304 to a second reference point 306. Further, L may be measured along the direction of the surface 300, from the first reference point 304 to a third reference point 308. The second reference point 306 and the third reference point 308 may be projected onto the head 200, to define junction points 310 on the exterior surface of the head 200. The second reference point 306 is projected onto the strike face 202 in a direction normal to the imaginary line 302, and the third reference point 308 is projected onto the sole 204 in a direction normal to the planar surface, as shown in FIG. 4(*b*).

H and L may thus dimensionally represent the junction 212 on the head 200 at a generally vertical planar location substantially perpendicular to the striking face 202, and delimited by the points 304, 306 and 308. To define the junction 212 in other areas of the head, a set of imaginary junction bounding lines 312 (on the face 202) and 314 (on the sole 204, the skirt 206 and the crown 208) may be traced on the head 200 to form a closed loop, passing through the junction points 310 and maintaining a substantially constant distance (d', d") from a reference feature, for example, each imaginary junction bounding line 312 may be parallel to the face perimeter edge 205, as shown in FIGS. 4(*b*) and 5.

As an example, for a metalwood driver having a volume of, e.g., 300-600 $cm^3$, both H and L may have values of up to about 20 mm. More preferably, both H and L may have values up to about 14 mm. More preferably still, H may have a value of up to about 12 mm, and L may have a value of up to about 10 mm.

The junction 212 may be locally stiffened to improve the performance of the head 200. In particular, certain performance advantages may be gained by introducing local stiffening at selected locations.

Figure 6:
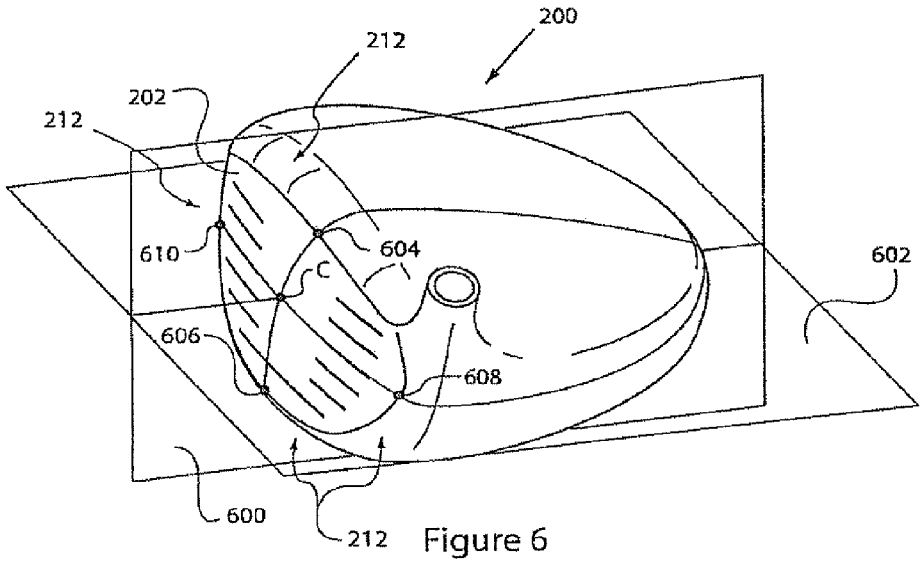
FIG. 6 is a perspective view of the club head of FIG. 1 showing exemplary aspects thereof.
Figure 8:
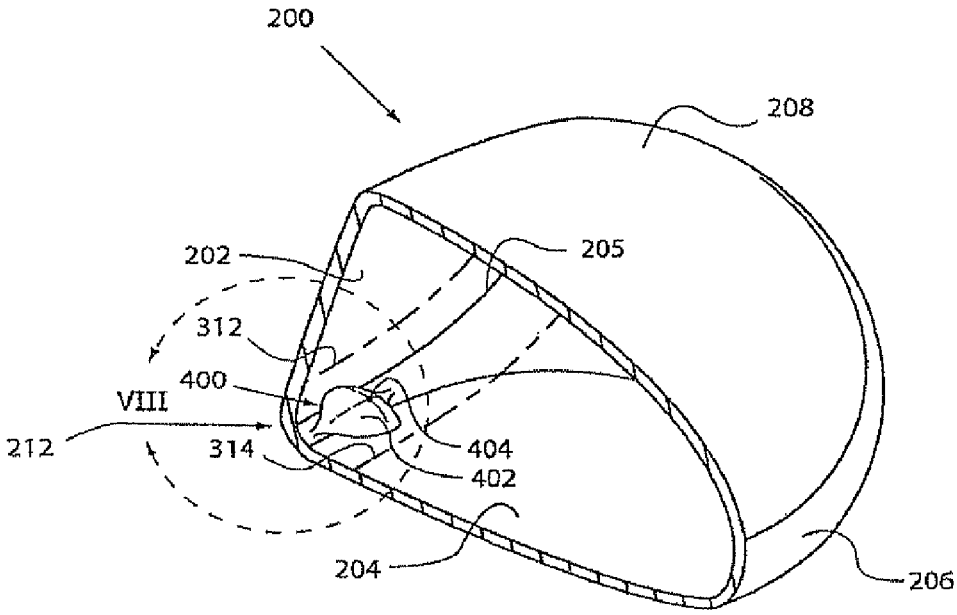
FIG. 8(*a*) is a cut-away perspective view of the club head of FIG. 1 showing an exemplary internal feature thereof.
Figure 8:
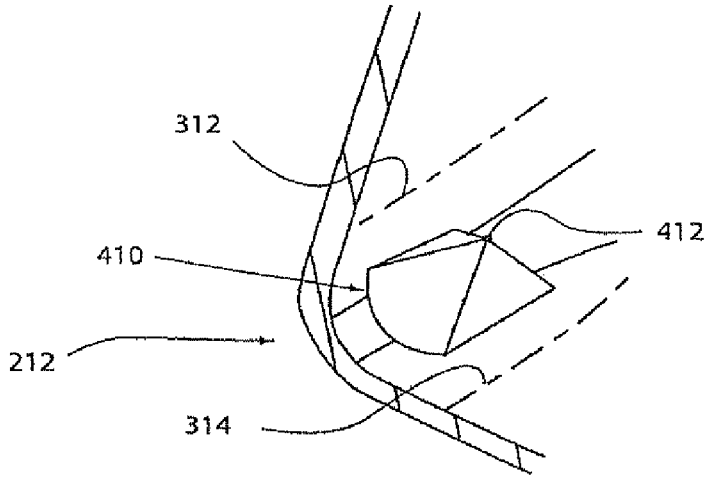
Figure 8:
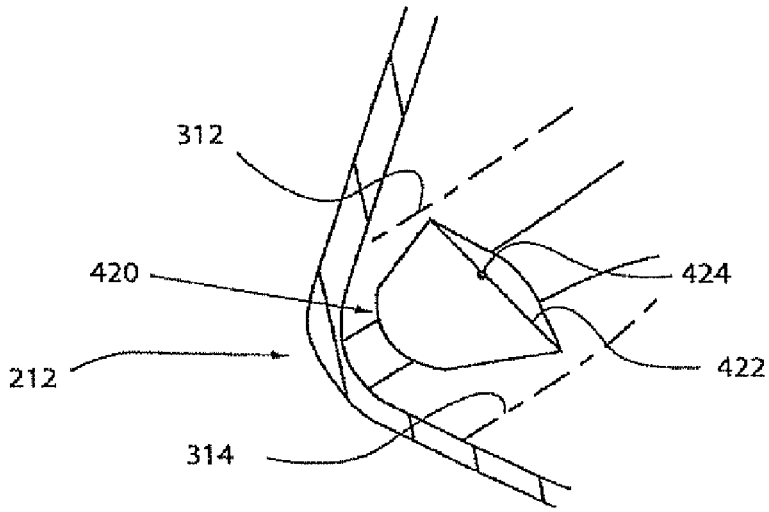
Figure 8:
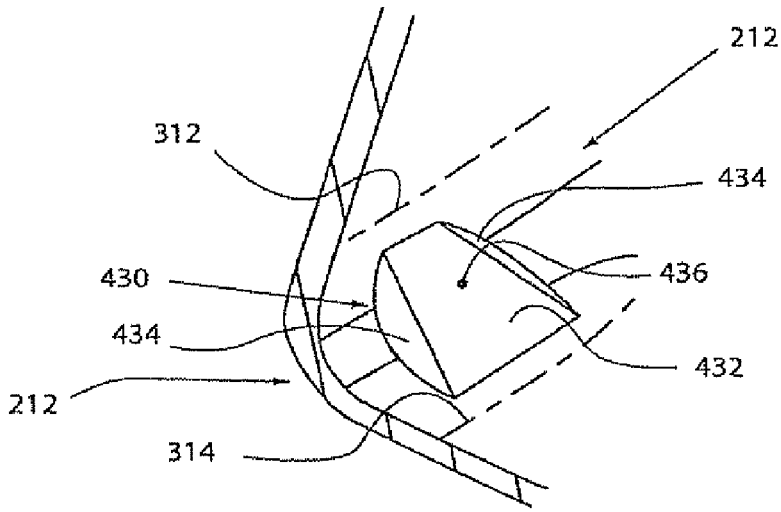
Figure 8:
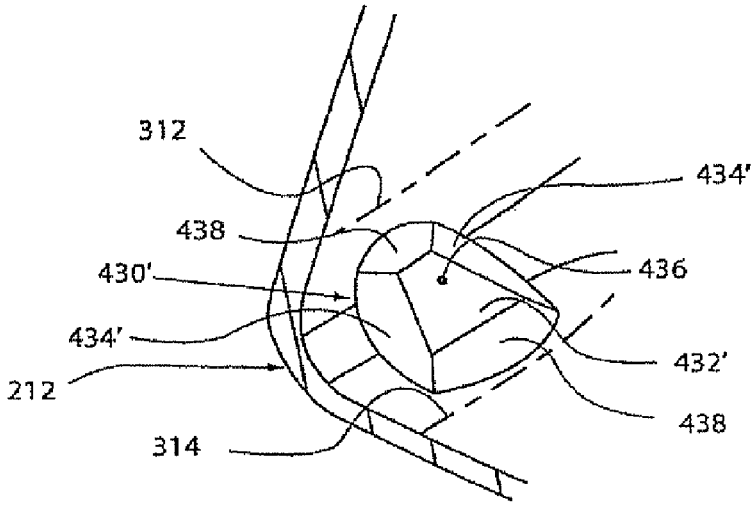
Figure 8:
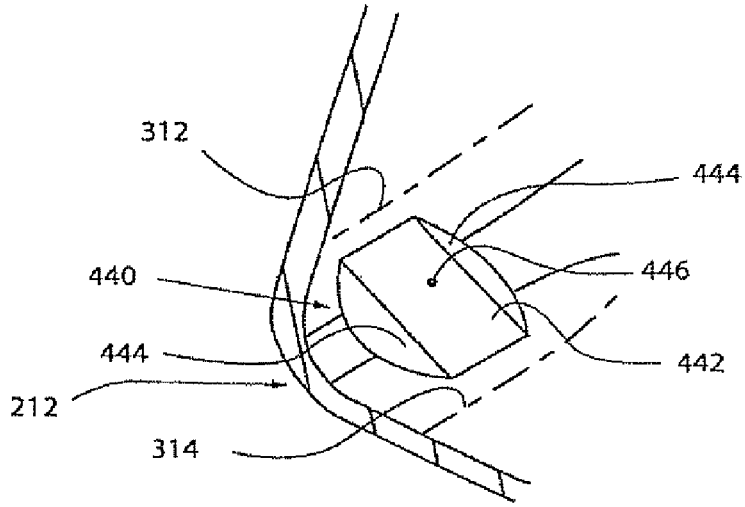
Figure 8:
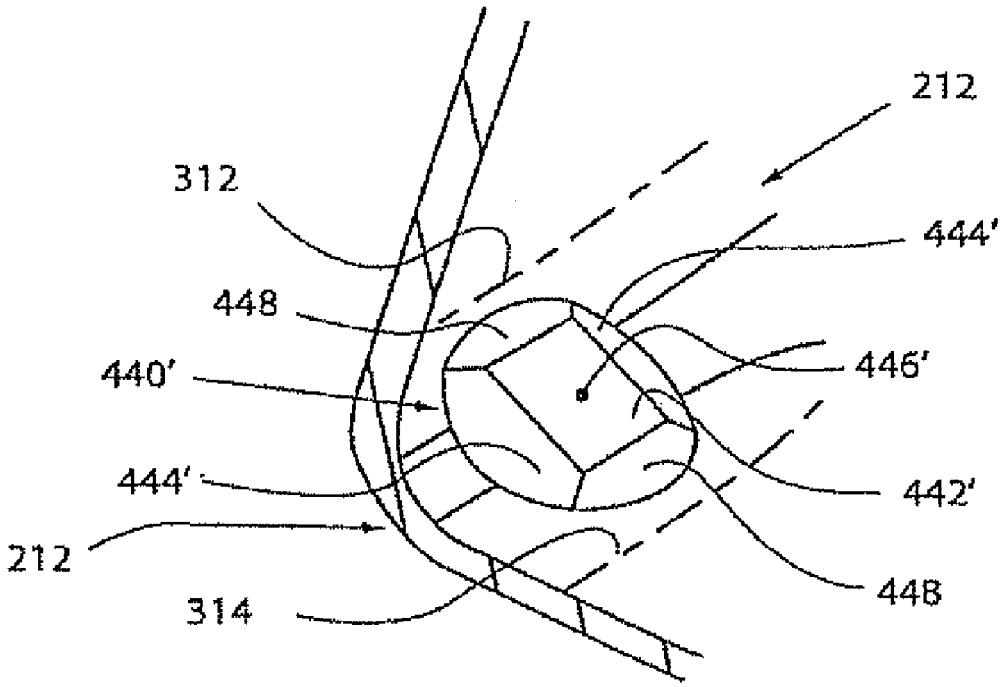
Figure 8:
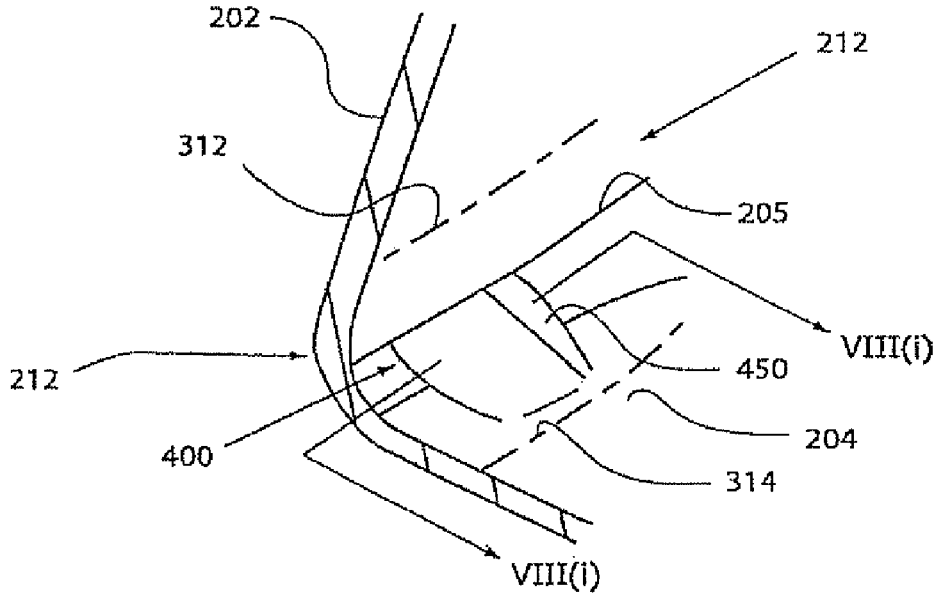
Figure 8:
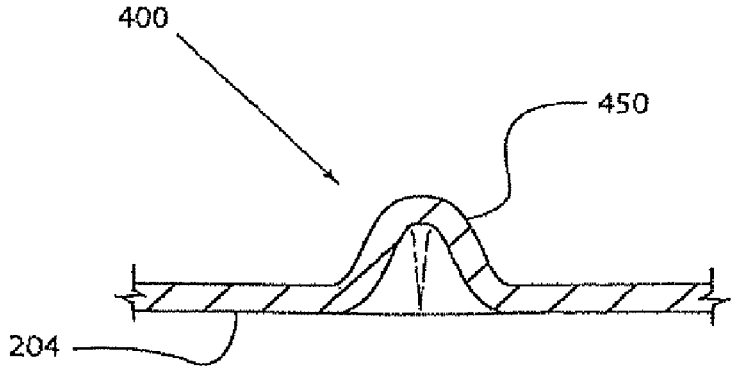

For example, at least one stiffening member 400 (see FIGS. 8(*a*), 15(*a*), and 15(*b*)) may be generally positioned so as to be proximate the intersection of the junction 212 and a vertical plane 600 and/or a horizontal plane 602 that pass through center C of the striking face 202, as shown in FIG. 6. Since the junction 212 generally extends annularly about the center of the striking face 202, four locations are defined proximate to which at least one stiffening member may be located to obtain beneficial results, and may be represented by the points 604, 606, 608 and 610. The points 604, 606, 608 and 610 define a top location, a bottom location, a heel location, and a toe location, respectively, and are intended only as a general indication of approximate locations for at least one stiffening member 400.

Figure 7:
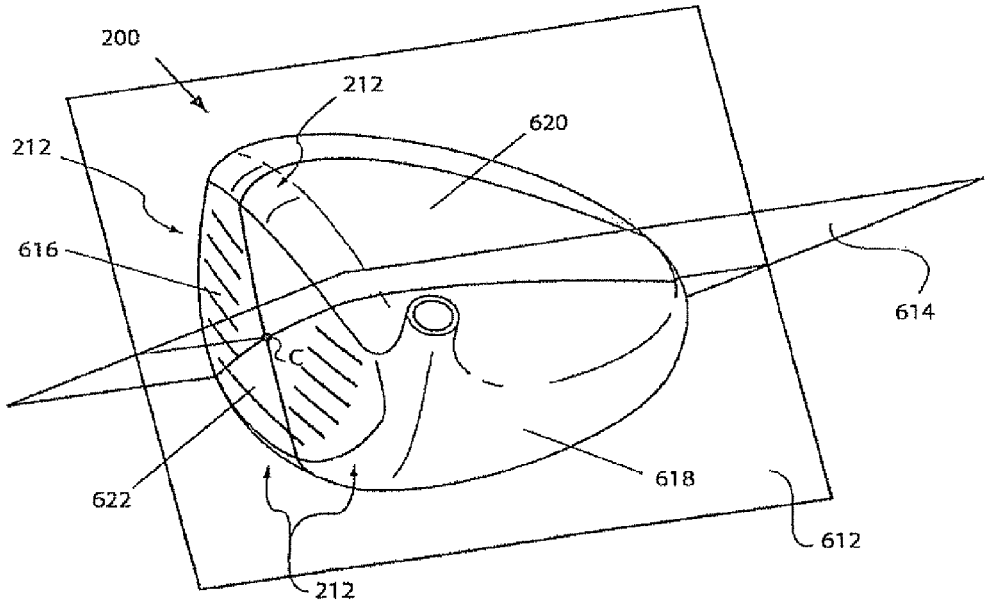
FIG. 7 is a perspective view of the club head of FIG. 1 showing exemplary aspects thereof.

As shown in FIG. 7, the imaginary planes 612 and 614 may be oriented about +45 and −45 degrees to horizontal. Said planes may intersect the head 200 proximate center C of the striking face 202, so as to generally divide the head 200 into a toe region 616, a heel region 618, a top region 620 and a bottom region 622. The top region 620 and the bottom region 622 have a heel-to-toe length dimension. Preferably, multiple stiffening members may be located on the junction 212 in any or all of the above regions, in any combination. More preferably, stiffening members may be provided at the junction 212 in both regions 616 and 618, or in both regions 620 and 622. Even more preferably, a single stiffening member may be provided at the junction 212 in the region 622 and/or at the junction 212 in the region 620.

Generally, the stiffening member 400 may comprise a mass provided within the junction 212. The mass may be formed integrally with at least a portion of the junction 212, and may have a variety of configurations. For example, as shown in FIG. 8(*a*), the stiffening member 400 may be a contoured mass 402. The mass 402 may have at least one peak 404, where the true thickness, T, (shown in FIG. 10) of the stiffening member is a maximum and decreases away from the peak 404. While the contoured mass 402 is shown as a single, mound-shaped mass in this embodiment, it should be appreciated that such a mass may have a variety of shapes.

Alternatively, the stiffening member 400 may be a geometrically shaped mass, examples of which are shown in FIGS. 8(*b*)-(*e*). FIG. 8(*b*) shows a substantially pyramid-shaped mass 410, having a peak 412, where T (shown in FIG. 10) decreases away from the peak.

FIG. 8(*c*) shows a prism-shaped mass 420 substantially longitudinally disposed in the front-to-rear direction of the club head. The mass has a spine 422, where T (shown in FIG. 10) decreases away from the spine in the heel and toe (lateral) directions. In one example, T may also decrease away from a point of maximum true thickness 424, located on the spine 422 in the longitudinal direction.

FIG. 8(*d*) shows a substantially trapezoid-shaped mass 430, having a plateau 432 and sides 434, which slope away from the plateau. Generally, at least one point 436 may exist on the plateau 432 where T is a maximum.

FIG. 8(*e*) shows a mass 430' having additional sides 438 which may also slope away from a plateau 432'.

FIG. 8(*f*) shows a substantially rectangle-shaped mass 440 having a plateau 442, and sides 444, which may slope away from the plateau. Generally, at least one point 446 may exist on plateau 442 where T is a maximum.

FIG. 8(*g*) shows a mass 440' having additional sides 448 which may also slope away from a plateau 442'.

In addition, the stiffening member 400 may comprise at least one pleat or corrugation 450 in the wall portion forming the junction 212, as shown in FIG. 8(*h*). For added clarity, a cross section of the corrugation 450 is shown in FIG. 8(*i*). Although the corrugation 450 is shown here as not extending into the striking face 202 so as to conform to USGA rules which prohibit channels from extending into the striking face, it should be appreciated that should a non-conforming club head design be desired, the corrugation 450 may extend into the face 202. Further, it may be desirable for the corrugation 450 to extend outside of the junction 212 into the sole 204, for added reinforcement and/or cosmetic appeal (not shown). Should a single corrugation provide insufficient stiffness to the junction 212, a plurality of corrugations may be provided (not shown).

The preceding description recites several exemplary embodiments for the stiffening member 400. It should be appreciated in particular that a variety of other embodiments may be adapted for use as the mass portion of the stiffening member 400.

In all applicable configurations, the maximum thickness T of the mass member should generally be selected to impart sufficient stiffness to the junction 212 to provide the desired effects. For example, the maximum value of T may generally be greater than the average wall thickness of the junction 212. For example, the junction may have wall thicknesses ranging from about 0.4 mm to about 4 mm, and the maximum value of T may be between about 1 mm and about 8 mm. More preferably, the maximum value of T may be between about 3 mm and about 7 mm. Most preferably, the maximum value of T may be between about 4 mm and about 6 mm.

Figure 11:
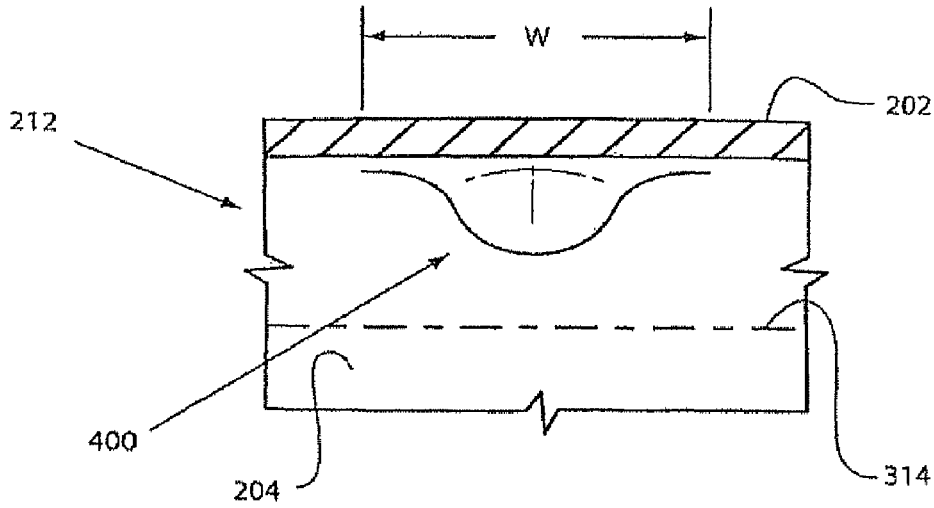
FIG. 11 is a top view of the detail of FIG. 10.

Further, as illustrated in FIG. 11, the stiffening member 400 may have a width, W, that may range from about 2 mm to about 15 mm. More preferably, the width may generally be from about 3 mm to about 7 mm.

Figure 9:
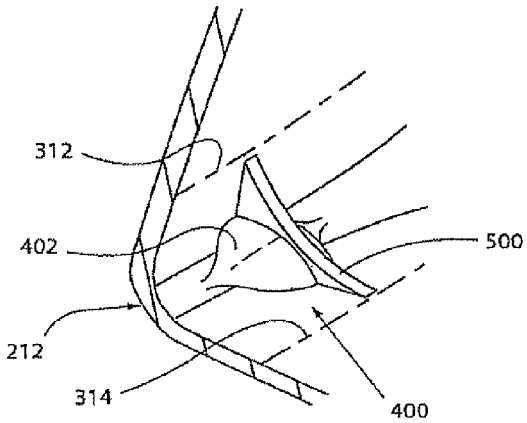
FIG. 9(*a*) is an enlarged view of an exemplary detail VIII of FIG. 8(*a*).
Figure 9:
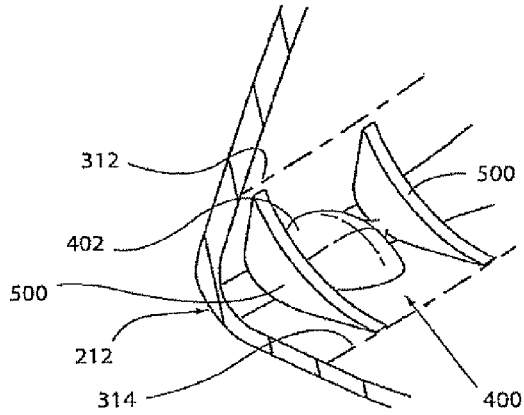
Figure 9:
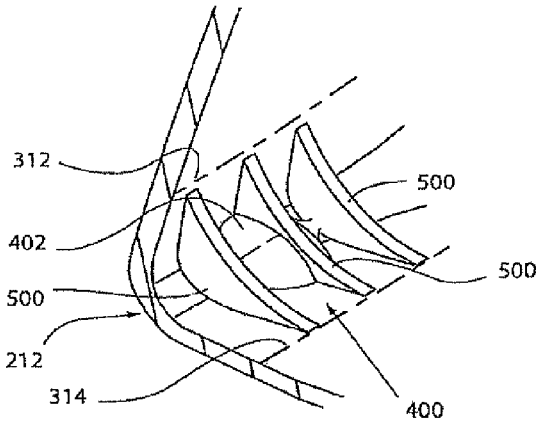

In addition, the stiffening member 400 may comprise at least one rib 500 provided on the junction 212, as shown in FIGS. 9(*a*)-9(*c*) and 15(*a*)-15(*c*). Preferably, rib(s) 500 may be provided in addition to, e.g., mass 402. It may also be preferable that rib(s) 500 be formed integrally with either the junction 212 or the mass 402, or both. Preferably, several ribs 500 may be provided on the junction 212 proximate to and/or or integrally with the mass 402. More preferably, rib(s) 500 may be formed on the mass 402. FIGS. 9(*a*) and 15(*a*) show one rib 500 generally intersecting the mass 402. In FIGS. 9(*b*) and 15(*b*), two ribs 500 are shown on either side of the mass 402. In FIGS. 9(*c*) and 15(*c*), three ribs 500 are shown distributed across the width of the mass 402. The number, size, and location of the ribs may depend on the overall configuration of the stiffening member 400 and an analysis of the effect a mass member alone has on the impact efficiency of the head 200. The mass 402 is shown above as an example only, and it should be appreciated that the use of ribs may complement any mass member configuration.

Figure 10:
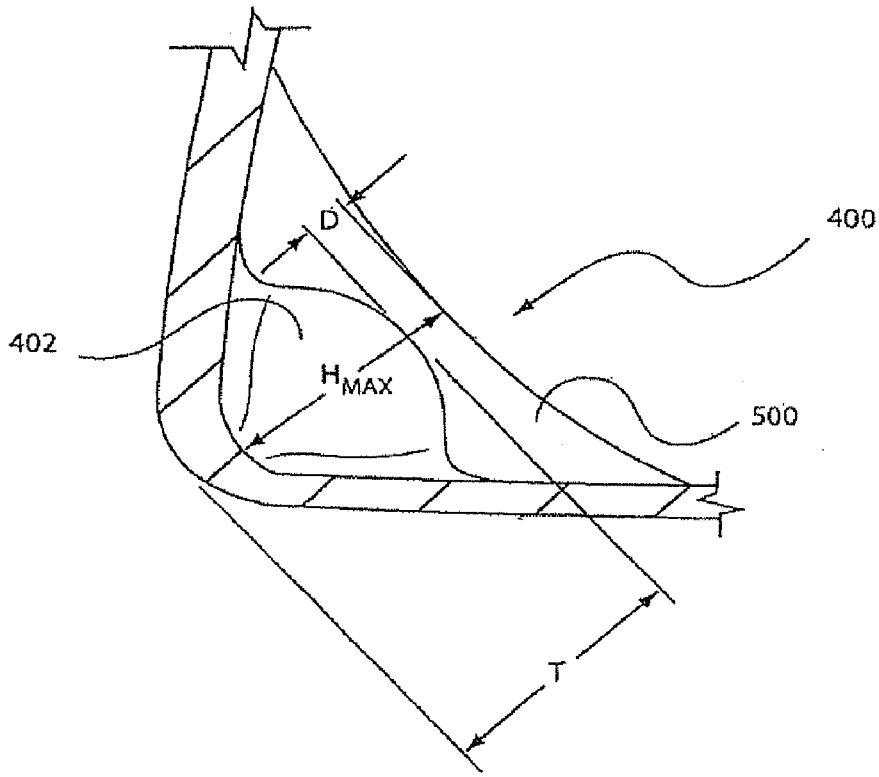
FIG. 10 is an enlarged side view of detail VIII of FIG. 8(*a*).

Generally, if rib(s) 500 are incorporated, they may have a maximum true height, $H_{MAX}$, from about 2 mm to about 12 mm, as shown in FIG. 10. Optionally, $H_{MAX}$ may be selected such that rib(s) 500 extend a distance D beyond the maximum true thickness, T, of the mass member, e.g. mass member 402. D may generally have values between about 0.1 mm and about 10 mm.

Generally, the introduction of the stiffening member 400 at the junction 212 may allow a reduction in thickness of the striking face 202 while maintaining a maximum COR of 0.830 or less per USGA rules as well as the structural integrity of the head 200. The stiffening member 400 may further allow for a COR of substantially 0.830 to be achieved over a greater percentage of surface area of the face 202. Alternatively, the stiffening member 400 may allow for a maximum COR that is higher than the USGA mandated maximum over a greater percentage of surface area of the face 202. More generally, the stiffening member 400 may increase COR values on the face 202, resulting in a higher average COR value for the face 202.

Figure 12:
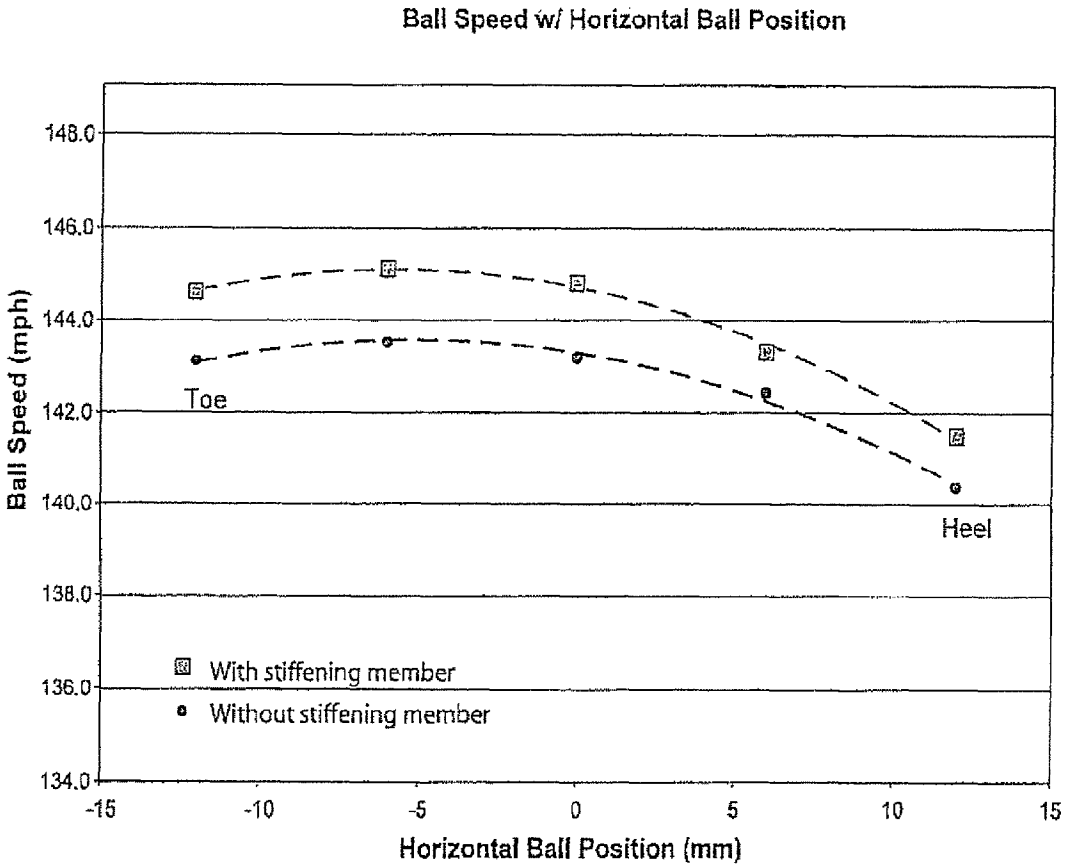
FIG. 12 is a graph comparing ball speed at various horizontal face positions on a golf club with and a golf club without features in accordance with the present invention.
Figure 13:
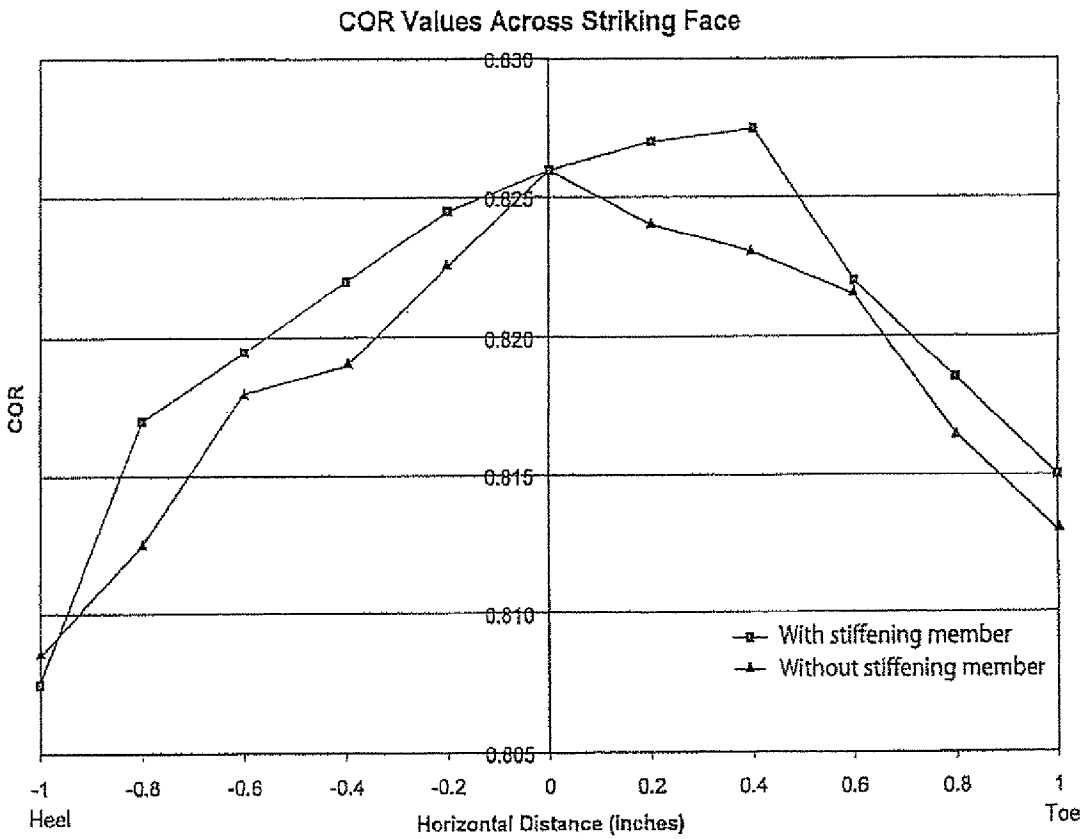
FIG. 13 is a graph comparing COR at various horizontal face positions on a golf club with and a golf club without features in accordance with the present invention.
Figure 14:
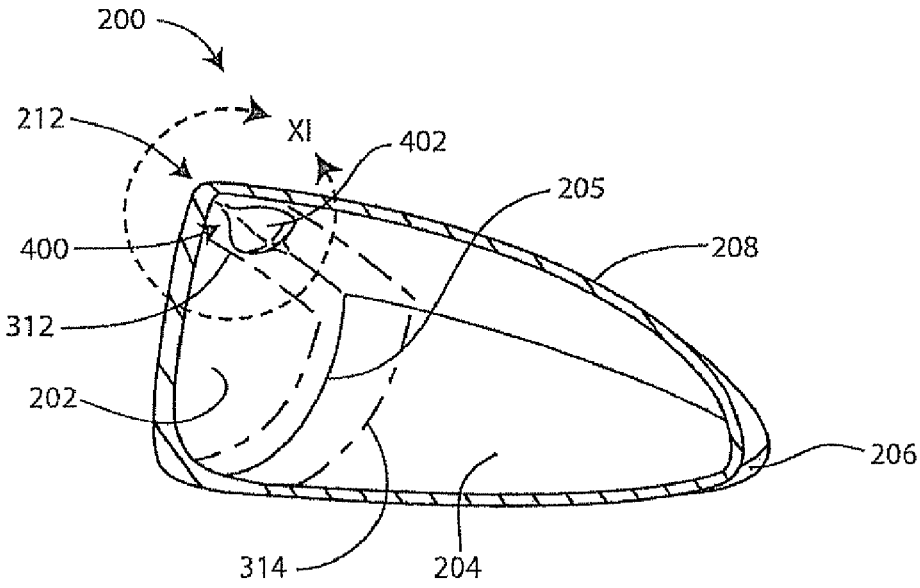
FIG. 14(*a*) is a cut-away perspective view of the club head of FIG. 1 showing exemplary aspects thereof.
Figure 14:
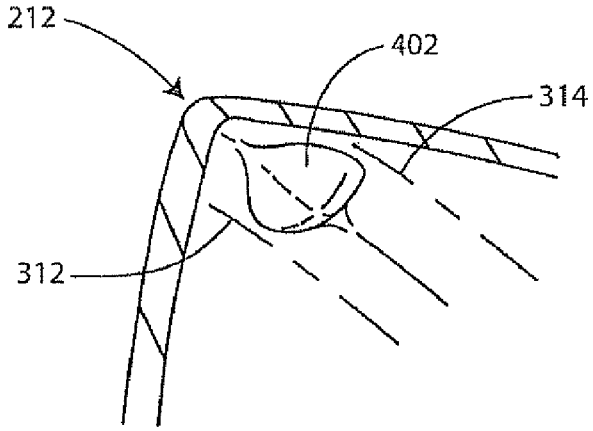
Figure 15:
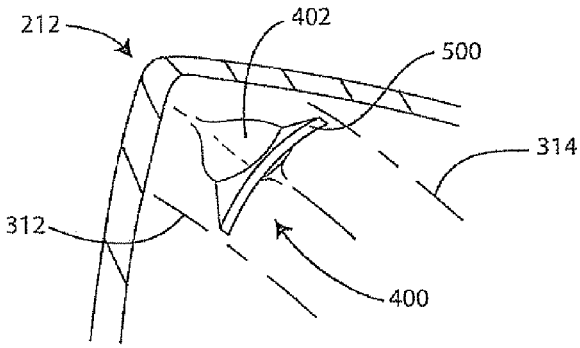
FIG. 15(*a*) is an enlarged view of an exemplary detail XI of FIG. 14(*a*).
Figure 15:
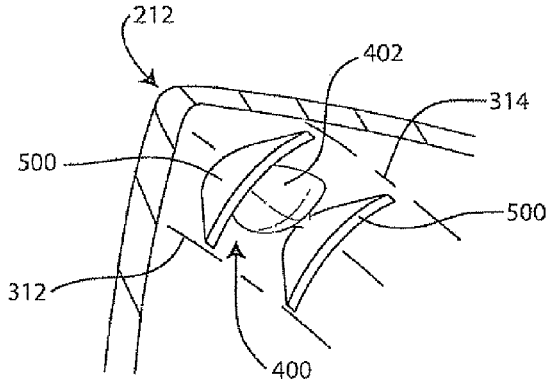
Figure 15:
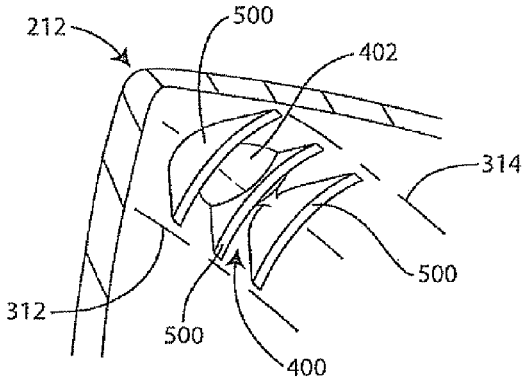

For identical club heads of a given face thickness, or thickness profile, it was found that the stiffening member 400 increases ball speed values across face 202. Two heads similar to that shown in FIG. 1 were comparison tested to demonstrate the results. In the first head, a single stiffening member 400, such as one shown in FIG. 9(*c*), was provided in the junction 212 at a location generally corresponding to location 606 of FIG. 6, and ball speed values and COR values were recorded at various locations laterally along the face 202. The same measurements were recorded for a second head which was not provided with a stiffening member, but which was otherwise substantially identical. The results are shown graphically in FIGS. 12 and 13. FIG. 12 shows ball speed values measured at various locations horizontally across the face, demonstrating increased ball speed values overall for the head provided with the stiffening member 400. FIG. 13 shows COR values measured at various locations horizontally across the face 202, demonstrating increased COR across the face of the head provided with the stiffening member 400. Similar results were obtained when applying the same principles to optimize striking face performance vertically along the face.

Further, the introduction of the stiffening member 400 may also enable the point of maximum COR to be repositioned to an area that may be more desirable without altering external head geometry and shape. For example, it may be believed that, on average, golfers strike the ball towards the toe of the club more frequently than at the geometric center of the face. In such an example, strategically placing the stiffening member 400 on the junction 212 to reposition the point of maximum COR towards the toe side of the face 202 may yield a club head that drives the ball longer, on average.

It should be noted that, although examples are given only showing the stiffening member 400 located internally within the head 200, the stiffening member may be equally effective when positioned on the exterior of the head on the junction 212. This may be particularly true when the junction 212 has an inwardly curved or concave configuration as shown in FIG. 3(*b*).

The above-described implementations of the broad principles described herein are given only as examples. Therefore, the scope of the invention should be determined not by the exemplary illustrations given, but by the furthest extent of the broad principles on which the above examples are based. Aspects of the broad principles are reflected in appended claims and their equivalents.

What is claimed is:

1. A golf club head comprising:

a sole configured to rest on a planar surface;

a crown;

a toe;

a heel opposite the toe;

a strike face having a maximum coefficient of restitution greater than 0.83 measured at a location that is spaced from a geometric center of the strike face by a horizontal distance of at least 0.2 inch, and wherein the coefficient of restitution of the geometric center is less than the maximum coefficient of restitution of the strike face;

a rear portion;

an interior cavity at least partially delimited by the sole, the crown, the strike face, and the rear portion;

a hosel; and at least one rib coupled to the striking face and at least one of the crown and the sole.

2. The golf club head of claim 1, wherein the at least one rib comprises a first rib and a second rib.

3. The golf club head of claim 1, wherein the interior cavity is fully enclosed.

4. The golf club head of claim 1, wherein:

the hosel comprises a hosel axis, wherein the club head is oriented so that the hosel axis is positioned at a designated lie angle relative to the planar surface;

the strike face comprises a geometric center and a face perimeter edge;

an imaginary vertical plane is perpendicular to the strike face and passes through the geometric center of the strike face, the imaginary vertical plane containing an imaginary line tangent to the strike face at the geometric center and intersecting the planar surface;

a first reference point is characterized by the intersection of the imaginary line and the planar surface;

a second reference point is located 20 mm away from the first reference point along the imaginary line in the direction of the crown;

a third reference point is located in the imaginary vertical plane 20 mm away from the first reference point along the planar surface in a direction substantially perpendicular to the strike face toward the rear portion;

a first junction point is located in the imaginary vertical plane, the first junction point defined by the projection of the second reference point onto the strike face in a direction normal to the imaginary line;

a second junction point is located in the imaginary vertical plane, the second junction point defined by the projection of the third reference point onto the sole in a direction normal to the planar surface;

a first imaginary junction-bounding line forms a closed loop and passes through the first junction point, wherein the first imaginary junction-bounding line is parallel to the face perimeter edge;

a second imaginary junction-bounding line forms a closed loop and passes through the second junction point, wherein the second imaginary junction-bounding line is parallel to the face perimeter edge;

a junction is delimited by the portion of the club head between the first imaginary junction-bounding line and the second imaginary junction-bounding line, the junction comprising a top region and a bottom region, each having a heel-to-toe length dimension; and a majority of the at least one rib is located within the junction.

5. The golf club head of claim 4, wherein the at least one rib is located entirely within the bottom region of the junction.

6. The golf club head of claim 4, wherein the at least one rib is located entirely within the top region of the junction.

7. The golf club head of claim 4, further comprising at least one mass located entirely within one of the top region and the bottom region.

8. The golf club head of claim 4, wherein the at least one rib comprises at least one first rib, located entirely within the bottom region of the junction, and at least one second rib, located entirely within the top region of the junction.

9. The golf club head of claim 1, wherein the maximum coefficient of restitution is located on the strike face toward the toe.

10. The golf club head of claim 1, further comprising a volume greater than 300 cc.

11. A golf club head comprising:

a sole configured to rest on a planar surface;

a crown;

a toe;

a heel opposite the toe;

a strike face having a maximum coefficient of restitution greater than 0.83 measured at a location that is spaced from a geometric center of the strike face by a horizontal distance of at least 0.2 inch, and wherein the coefficient of restitution of the geometric center is less than the maximum coefficient of restitution of the strike face;

a rear portion;

an interior cavity at least partially delimited by the sole, the crown, the strike face, and the rear portion;

a hosel; and at least one mass coupled to the striking face and at least one of the crown and the sole.

12. The golf club head of claim 11, wherein the interior cavity is fully enclosed.

13. The golf club head of claim 11, wherein:

the hosel comprises a hosel axis, wherein the club head is oriented so that the hosel axis is positioned at a designated lie angle relative to the planar surface;

the strike face comprises a geometric center and a face perimeter edge;

an imaginary vertical plane is perpendicular to the strike face and passes through the geometric center of the strike face, the imaginary vertical plane containing an imaginary line tangent to the strike face at the geometric center and intersecting the planar surface;

a first reference point is characterized by the intersection of the imaginary line and the planar surface;

a second reference point is located 20 mm away from the first reference point along the imaginary line in the direction of the crown;

a third reference point is located in the imaginary vertical plane 20 mm away from the first reference point along the planar surface in a direction substantially perpendicular to the strike face toward the rear portion;

a first junction point is located in the imaginary vertical plane, the first junction point defined by the projection of the second reference point onto the strike face in a direction normal to the imaginary line;

a second junction point is located in the imaginary vertical plane, the second junction point defined by the projection of the third reference point onto the sole in a direction normal to the planar surface;

a first imaginary junction-bounding line forms a closed loop and passes through the first junction point, wherein the first imaginary junction-bounding line is parallel to the face perimeter edge;

a second imaginary junction-bounding line forms a closed loop and passes through the second junction point, wherein the second imaginary junction-bounding line is parallel to the face perimeter edge;

a junction is delimited by the portion of the club head between the first imaginary junction-bounding line and the second imaginary junction-bounding line, the junction comprising a top region and a bottom region, each having a heel-to-toe length dimension; and a majority of the at least one mass is located within the junction.

14. The golf club head of claim 13, wherein the at least one mass is located entirely within the bottom region of the junction.

15. The golf club head of claim 13, wherein the at least one mass is located entirely within the top region of the junction.

16. The golf club head of claim 11, wherein the maximum coefficient of restitution is located on the strike face toward the toe.

17. The golf club head of claim 11, further comprising a volume greater than 300 cc.

18. A golf club head comprising:

a sole configured to rest on a planar surface;

a crown;

a toe;

a heel opposite the toe;

a strike face having a geometric center, a face perimeter edge, and a maximum coefficient of restitution greater than 0.83 measured at a location that is spaced from the geometric center by a horizontal distance of at least 0.2 inch, and wherein the coefficient of restitution of the geometric center is less than the maximum coefficient of restitution of the strike face;

a rear portion;

a fully-enclosed interior cavity at least partially delimited by the sole, the crown, the strike face, and the rear portion;

a hosel comprising a hosel axis, wherein the club head is oriented so that the hosel axis is positioned at a designated lie angle relative to the planar surface; and an imaginary vertical plane perpendicular to the strike face and passing through the geometric center of the strike face, the imaginary vertical plane containing an imaginary line tangent to the strike face at the geometric center and intersecting the planar surface;

a first reference point characterized by the intersection of the imaginary line and the planar surface;

a second reference point located 20 mm away from the first reference point along the imaginary line in the direction of the crown;

a third reference point located in the imaginary vertical plane 20 mm away from the first reference point along the planar surface in a direction substantially perpendicular to the strike face toward the rear portion;

a first junction point located in the imaginary vertical plane, the first junction point defined by the projection of the second reference point onto the strike face in a direction normal to the imaginary line;

a second junction point located in the imaginary vertical plane, the second junction point defined by the projection of the third reference point onto the sole in a direction normal to the planar surface;

a first imaginary junction-bounding line forming a closed loop and passing through the first junction point, wherein the first imaginary junction-bounding line is parallel to the face perimeter edge;

a second imaginary junction-bounding line forming a closed loop and passing through the second junction point, wherein the second imaginary junction-bounding line is parallel to the face perimeter edge;

a junction delimited by the portion of the club head between the first imaginary junction-bounding line and the second imaginary junction-bounding line, the junction comprising a top region and a bottom region, each having a heel-to-toe length dimension;

at least one rib coupled to the striking face and at least one of the crown and the sole, wherein a majority of the at least one rib is located within the junction.

* * * * *